US007866963B2

(12) United States Patent
Ascari et al.

(10) Patent No.: US 7,866,963 B2
(45) **Date of Patent: *Jan. 11, 2011**

(54) VARIABLE DELIVERY VANE OIL PUMP, IN PARTICULAR FOR OIL

(75) Inventors: Ennio Ascari, Formigine (IT); Lorenzo Campani, Formigine (IT)

(73) Assignees: H.P.E. High Performance Engeneering S.r.l., Modena (IT); O.M.P. Officine Mazzocco Pagnoni S.r.l., Funo (Bologna) (IT)

( * ) Notice: Subject to any disclaimer, the term of this patent is extended or adjusted under 35 U.S.C. 154(b) by 80 days.

This patent is subject to a terminal disclaimer.

(21) Appl. No.: 11/719,739

(22) PCT Filed: Nov. 18, 2005

(86) PCT No.: PCT/IB2005/003453

§ 371 (c)(1),
(2), (4) Date: Dec. 2, 2008

(87) PCT Pub. No.: WO2006/054159

PCT Pub. Date: May 26, 2006

(65) Prior Publication Data

US 2009/0110577 A1 Apr. 30, 2009

(30) Foreign Application Priority Data

Nov. 19, 2004 (IT) ..... BO2004A0716

(51) Int. Cl.
*F03C 4/00* (2006.01)
*F04C 2/00* (2006.01)
*F04C 14/18* (2006.01)

(52) U.S. Cl. ..... 418/26; 418/30

(58) Field of Classification Search ..... 418/24–27, 418/30

See application file for complete search history.

(56) References Cited

U.S. PATENT DOCUMENTS

| | | | | |
|---|---|---|---|---|
| 1,776,452 | A * | 9/1930 | Rosenthal | 418/258 |
| 2,393,223 | A * | 1/1946 | Rosen | 418/82 |
| 3,153,384 | A | 10/1964 | Castle et al. | |
| 4,616,985 | A * | 10/1986 | Hattori et al. | 418/178 |
| 7,108,493 | B2 * | 9/2006 | Clements et al. | 418/30 |

FOREIGN PATENT DOCUMENTS

| | | |
|---|---|---|
| FR | 778346 | 3/1935 |
| FR | 1285391 | 2/1962 |
| GB | 399357 | 10/1933 |
| WO | WO 0281921 A1 * | 10/2002 |

OTHER PUBLICATIONS

PCT International Search Report for PCT/IB2005/003453.

* cited by examiner

*Primary Examiner*—Theresa Trieu
(74) *Attorney, Agent, or Firm*—Robert C. Haldiman; Husch Blackwell LLP

(57) ABSTRACT

A variable delivery vane pump, in particular for oil, is provided with a stator (10) eccentrically mounted about a rotor (9), which is adapted to turn about one own longitudinal axis (6), and presents a plurality of grooves (15) radially outwardly opened and slidingly engaged, each, by a respective vane (17) the vanes (17) being arranged essentially in contact with the stator (10) by interposing at least one sliding element (19; 27) extending about the axis (6) according to an angle smaller than 360°.

14 Claims, 3 Drawing Sheets

VARIABLE DELIVERY VANE OIL PUMP, IN PARTICULAR FOR OIL

CROSS REFERENCE TO RELATED APPLICATIONS

This application is a U.S. National Phase Application of International Application PCT No. PCT/IB2005/003453 filed on Nov. 18, 2005, which claims the benefit of priority from Italian Patent Application No. BO2004A000716 filed on Nov. 19, 2004. The disclosures of International Application PCT No. PCT/IB2005/003453 and Italian Patent Application No. BO2004A000716 are incorporated herein by reference.

TECHNICAL FIELD

The present invention relates to a variable delivery vane pump, in particular for oil.

In particular, the present invention relates to a variable delivery vane pump of the type comprising a rotor, which is mounted to turn about its longitudinal axis, and presents a plurality of outwardly radially open grooves; a stator, which extends about the rotor, and is eccentrically mounted with respect to the rotor itself; a plurality of vanes, each of which is slidingly mounted inside a respective groove, and presents an outer edge facing the stator; and adjusting means for selectively controlling the eccentricity between the rotor and the stator and, therefore, the delivery of the pump.

BACKGROUND ART

The known variable delivery vane pumps of the type described above present some drawbacks mainly deriving from the fact of presenting a relatively high sliding friction between the vanes and the stator.

DISCLOSURE OF INVENTION

It is the object of the present invention to provide a variable delivery vane pump, particular for oil, which is free from the aforementioned drawbacks.

According to the present invention, there is provided a variable delivery vane pump, in particular for oil, as claimed in the attached claims.

BRIEF DESCRIPTION OF THE DRAWINGS

The present invention will now be described with reference to the accompanying drawings illustrating a non-limitative embodiment example thereof, in which.

BEST MODE FOR CARRYING OUT THE INVENTION

Figure 1:
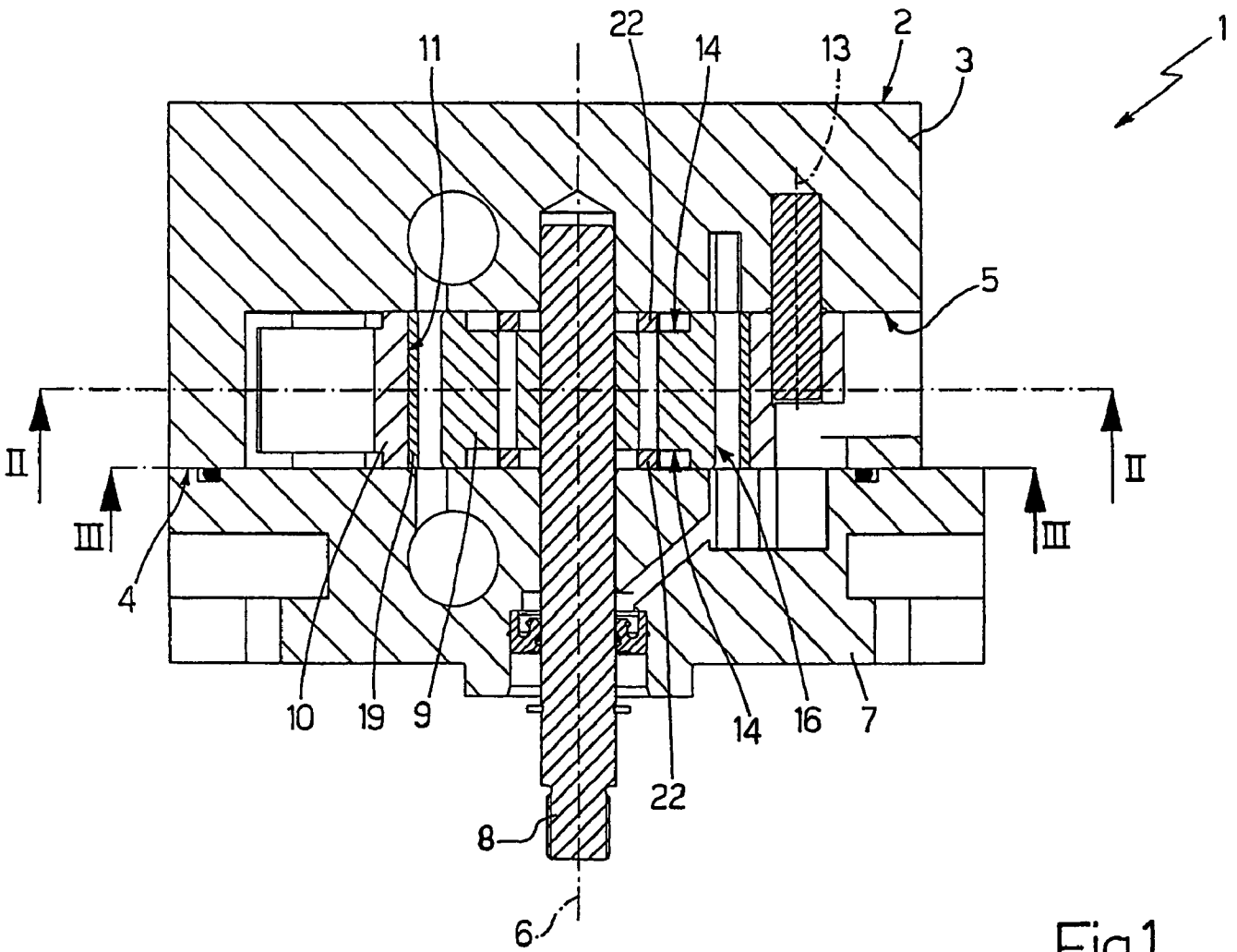
FIG. 1 is a schematic longitudinal section of a preferred embodiment of the vane pump of the present invention.

With reference to figures from 1 to 3, it is indicated by 1, as a whole, a variable delivery vane pump, in particular for feeding oil to a lubrication circuit (not shown) of an internal combustion engine (not shown) of a vehicle (not shown).

The pump 1 comprises a supporting case 2, which has an essentially parallelepiped rectangular section, and comprises, in turn, a first plate 3 laterally limited by an essentially flat surface 4. The plate 3 is provided with a cavity 5, which presents a longitudinal axis 6 orthogonal to the surface 4, opens outwardly at the surface 4, and is axially closed by a second plate 7 arranged in contact with the surface 4 itself.

The pump 1 further comprises a power shaft 8, which is mounted through the plates 3 and 7 to turn about the axis 6, and carries a keyed cylindrical rotor 9, which is housed inside the cavity 5, and presents a width, measured parallelly to the axis 6, essentially equal to the width of the cavity 5, also measured parallelly to the axis 6.

The cavity 5 further houses inside a stator 10, which extends about the rotor 9, presents a width, measured parallelly to the axis 6, essentially equal to the width of the cavity 5 also measured parallelly to the axis 6, and is internally limited by an essentially cylindrical surface 11 arranged in eccentric position with respect to the rotor 9.

The stator 10 is hinged to the plate 3 to oscillate, with respect to the plate 3 itself and under the control of an adjusting device 12 of the known type, about a fulcrum axis 13 parallel to the axis 6 and, therefore, allowing to selectively control the eccentricity between the rotor 9 and the surface 11.

The rotor 9 presents two cylindrical reciprocally opposite cavities 14, which are obtained coaxially to the axis 6, and one facing the plate 3 and the other the plate 7, and is provided with a plurality of radial grooves 15 (in the case shown, six grooves 15), which are obtained through the rotor 9 parallelly to the axis 6, are uniformly distributed about an axis 6, open radially outwardly at an outer surface 16 of the rotor 9 coaxially to the axis 6, and further open axially outwardly at the cavities 14.

Each groove 15 is slidingly engaged by a vane 17 presenting an outer edge 18, which extends parallelly to the axis 6, and is essentially arranged in contact with the surface 11 of the stator 10 by arranging a shoe 19 in between.

The shoe 19 presents a width measured parallelly to the axis 6, essentially equal to the width of a vane 17 also measured parallelly to the axis 6, extends about the axis 6 according to an angle smaller than 360°, and is slidingly circumferentially coupled both to the stator 10, and to the vanes 17, and presents two curved ends 20, one of which is essentially arranged in contact with a respective vane 17.

Each vane 17 axially projects from the respective groove 15 inside the cavities 14, and presents an inner edge 21, which extends parallel to the axis 6, and is essentially arranged in contact with two annular elements 22, each of which is accommodated inside one of the cavities 14, extends about the shaft 8, and presents a diameter larger than the diameter of the shaft 8 and smaller than the diameter of the respective cavity 14 so as to float inside the respective cavity 14 itself.

Each pair of respectively adjacent vanes 17 circumferentially defines a respective pumping chamber 23, which is further radially limited by the rotor 9 and by the shoe 19 and axially by the plates 3 and 7, is shifted by the rotor 9 about the axis 6 and through a suction inlet 24 and a delivery outlet 25 of the oil, and presents, following the rotation of the rotor 9 about the axis 6 and the eccentricity between the rotor 9 and the surface 11 of the stator 10, a variable volume.

Furthermore, with regard to this it is important to point out that the volume of each chamber 23 at the inlet 24 and the outlet 25 and, therefore, the delivery of the pump 1 are selectively controlled by shifting the stator 10 about the axis 13 and, therefore, modifying the eccentricity between the rotor 9 and the surface 11 of the stator 10 itself.

Figure 2:
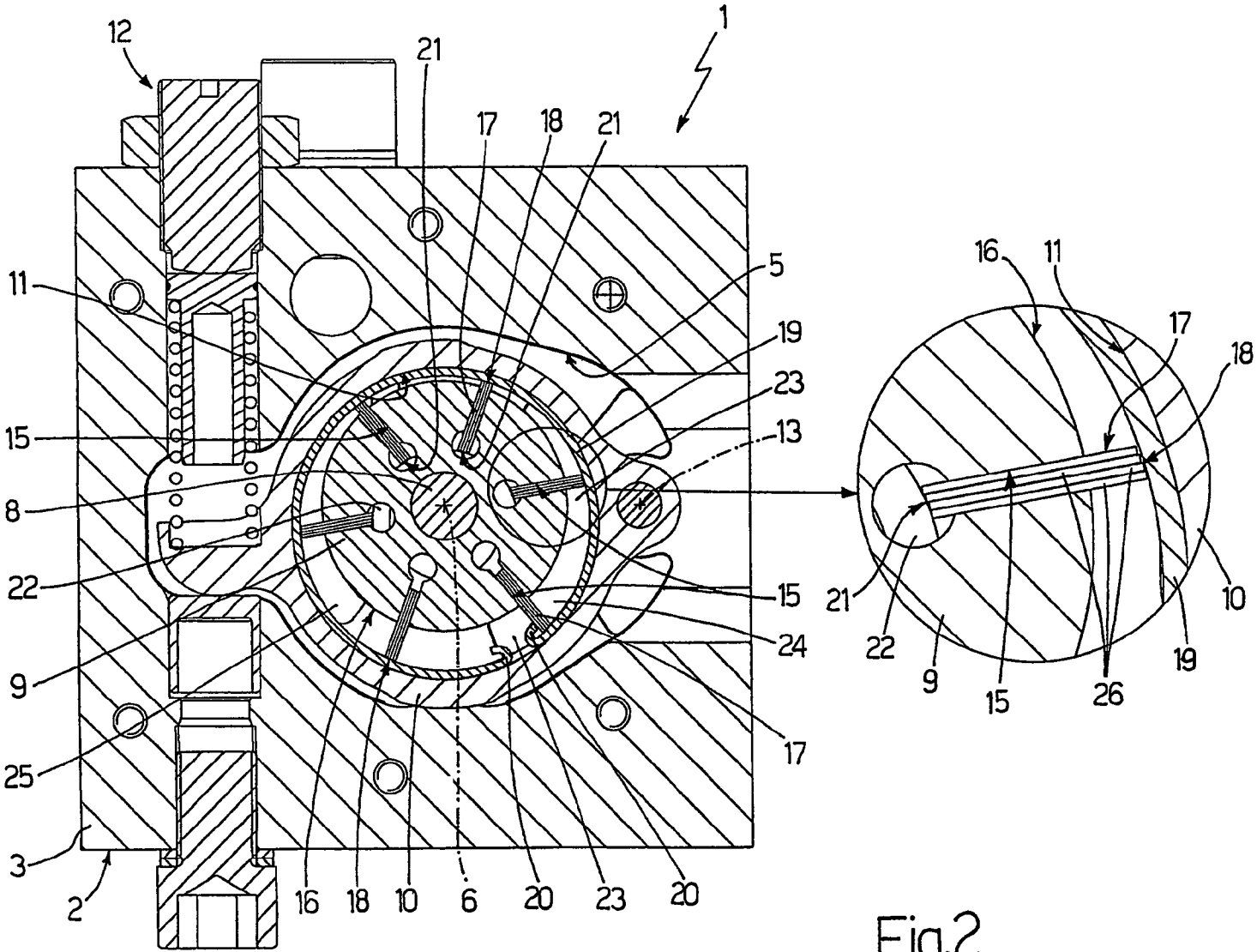
FIG. 2 is a section taken along line II-II in FIG. 1.

As shown in FIG. 2, each vane 17 comprises a plurality of foils 26 (in the case shown, four foils 26), which are reciprocally overlapped, and are slidingly radially coupled one to the other to ensure a relatively efficient fluidtight coupling between the vane 17 and the shoe 19.

Figure 4:
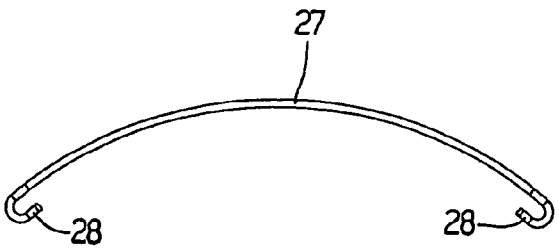
FIG. 4 is a lateral view of a variation of a detail in the figures from 1 to 3.
Figure 3:
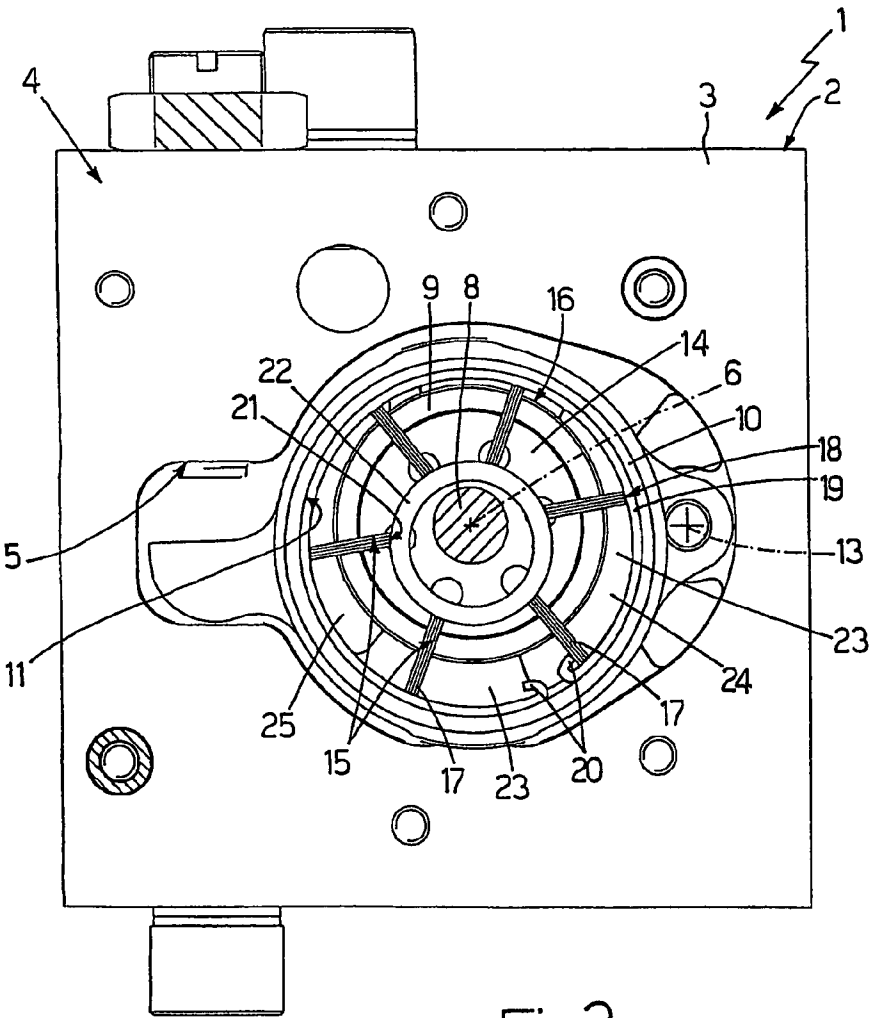
FIG. 3 is a section taken along line III-III in FIG. 1.

With reference to FIG. 4, the shoe 19 is replaced with a plurality of shoes 27 (in the case shown, three shoes 27), each of which is arranged between the surface 11 and two respective vanes 17, and is slidingly circumferentially coupled to the surface 11 and to the respective vanes 17, and presents two curved ends 28, one of which is essentially arranged in contact with a respective vane 17.

According to a variation not shown, the shoes 19 and 27 are housed inside the respective cavities, which are obtained in the stator 10, and open outwardly at the surface 11, and project outwardly from the respective cavities to arrange themselves in contact with the respective vanes 17.

According to a further variation not shown the curved ends 20, 28 of each shoe, 19, 27 are replaced with two enlarged edged 20, 28 parallel to the axis 6.

The operation of the pump 1 is easily inferred from the description above and does not required further explanations.

The invention claimed is:

1. A variable delivery vane pump, for oil, the pump comprising:

a rotor, said rotor being mounted to turn about a determined longitudinal axis, of its, and to present a plurality of grooves outwardly radially open at a surface coaxial to said axis;

a stator, said stator extending about the rotor, and being eccentrically mounted with respect to the rotor itself;

a plurality of vanes each of said vanes being slidingly mounted inside a respective one of said groove, each of said vanes presenting an outer edge facing the stator;

an adjustor said adjustor selectively controlling the eccentricity between the rotor and the stator; and at least one sliding element, said sliding element being arranged between the stator and the outer edges of the vanes, and extending about the axis according to an angle smaller than 360°; and said sliding element having a projection, said projection being disposed to engage one of said vanes.

2. A pump according to claim 1 further comprising a single one of said sliding element.

3. A pump according to claim 1 further comprising at least two of said sliding elements distributed about said axis.

4. A pump according to claim 1 further comprising each of said sliding elements being slidingly circumferentially coupled to the stator and to the vanes.

5. A pump according to claim 1 further comprising each of said sliding elements presenting two curved ends.

6. A pump according to claim 1, further comprising each of said sliding elements presenting two enlarged end edges essentially parallel to said axis.

7. A pump according to claim 1 and further comprising two annular elements, said annular elements being arranged on opposite bands of the rotor parallel to said axis, and extending about the axis itself; each vane axially projecting from said respective groove and presenting an inner edge essentially arranged in contact with said annular elements.

8. A variable delivery vane pump, for oil, the pump comprising:

a rotor, said rotor being mounted to turn about a determined longitudinal axis, and to present a plurality of grooves outwardly opening at one surface thereof, coaxial to said axis;

a stator, said stator extending about the rotor, and being eccentrically mounted with respect to the rotor;

a plurality of vanes, each of said vanes being slidingly mounted inside a respective one of said groove, each of said vanes presenting an outer edge facing the stator;

an adjustor said adjustor selectively controlling the eccentricity between the rotor and the stator; and each vane comprising at least two foils reciprocally overlapped and slidingly coupled one to the other;

at least one sliding element, said sliding element extending about the axis according to an angle smaller than 360°, and being arranged between the stator and the vanes; and each of said sliding elements presenting at least one of a curved end or an enlarged end edge.

9. A variable delivery vane pump for oil, the pump comprising:

a rotor, said rotor being mounted to turn about a determined longitudinal axis, of its, and to present a plurality of grooves outwardly radially open at a surface coaxial to said axis;

a stator, said stator extending about the rotor, and being eccentrically mounted with respect to the rotor itself;

a plurality of vanes each of said vanes being slidingly mounted inside a respective one of said groove, each of said vanes presenting an outer aspect facing the stator;

an adjustor said adjustor selectively controlling the eccentricity between the rotor and the stator; and at least one sliding element, said sliding element being arranged between the stator and the outer aspect of the vanes, and extending about the axis; and said sliding element having a projection, said projection being disposed to engage one of said vanes.

10. The pump according to claim 9 wherein said projection is a curved end.

11. The pump of claim 9 wherein said projection is comprised of two curved ends.

12. The pump of claim 9 wherein said projection is an enlarged end edge.

13. The pump of claim 9 wherein said projection is comprised of two enlarged end edges.

14. The pump of claim 9 wherein said sliding element extends about the axis according to an angle smaller than 360°.

* * * * *